US005346392A

United States Patent [19]

Kim

[11] Patent Number: 5,346,392

[45] Date of Patent: Sep. 13, 1994

[54] CIGARETTE-SHAPED GAS LIGHTER

[76] Inventor: Jong-Il Kim, #94-1 Suyu 1-dong, Tobong-gu, Seoul, Rep. of Korea

[21] Appl. No.: 98,784

[22] Filed: Jul. 29, 1993

[30] Foreign Application Priority Data

Jul. 30, 1992 [KR] Rep. of Korea ..... 1992-14208

[51] Int. Cl.[5] ..... F23Q 1/02

[52] U.S. Cl. ..... 431/277; 431/125; 431/344

[58] Field of Search ..... 431/125, 126, 344, 276, 431/277, 144, 253, 254, 255

[56] References Cited

U.S. PATENT DOCUMENTS

| | | | |
|---|---|---|---|
| 4,457,697 | 7/1984 | Kitabayashi | 431/277 |
| 4,687,437 | 8/1987 | Springer | 431/277 |
| 4,927,747 | 5/1990 | Nitta | 431/344 |
| 5,213,493 | 5/1993 | Iwahori | 431/277 |

*Primary Examiner*—James C. Yeung

*Attorney, Agent, or Firm*—Birch, Stewart, Kolasch & Birch

[57] ABSTRACT

A cigarette-shaped gas lighter suitable for carrying in a conventional cigarette pack. The gas lighter includes a solid main body having a mounting base, a spark generating unit having a lighter flint and a serrated spool sparker, a gas injection regulating unit including a cylinder and a gas regulating member received in the cylinder such that the gas inlet chamber is received in the cylinder and the gas nozzle protrudes out of the main body. A lever pin is provided for lifting the gas injection regulating unit to allow gas to be projected from the gas nozzle, a cap having a gas recharger is hermetically screwed on the bottom of the main body with a packing interposed therebetween, and a top cover is mounted on the mounting section of the main body and having a flame projection opening for allowing a flame to rush to the outside of the gas lighter. The gas regulating member includes a gas inlet chamber which communicates with the gas nozzle as well as with the inside of the cylinder.

3 Claims, 5 Drawing Sheets

CIGARETTE-SHAPED GAS LIGHTER

BACKGROUND OF THE INVENTION

1. Field of the Invention

The present invention relates in general to a gas lighter, and more particularly to a slender cylindrical gas lighter suitable for carrying in a conventional cigarette pack.

2. Description of the Prior Art

A lighter, such as a gas lighter, is primary used with a cigarette. Thus, it is more efficient to carry the lighter with a smoker that the tighter is easily found whenever it is needed. From the viewpoint of the aforementioned, it is most desirable to carry the lighter in a cigarette pack. However, known gas lighters of the disposable type or of the rechargeable type have short and fat appearances, respectively, such that they can not be stored in a conventional cigarette pack and may only be stored in a pocket. When the lighter is carried in a pocket, it causes an inconvenience because the user must search his pockets for the lighter whenever he needs to use the lighter. Since the known gas lighter and the cigarette pack are separately carried is frequently lost the lighter is frequently lost.

Moreover, the gas injection regulating unit of the known gas lighter comprises varieties of elements and has a complex. construction, thereby causing a problem of increase of the manufacturing cost as well as a complicated and long assembling process. In addition to the above problem, the known gas lighter is inconvenient since the force of the fire or the size of the flame should be manually controlled to continue a desired level irrespective of an outside condition.

With reference to FIG. 9, there is shown in a sectional view a gas injection regulating unit of a known gas lighter. As shown in this drawing, a gas regulator mounting base 51 is separately prepared and fixed onto a main body 50 of the gas lighter. The mounting base 51 is provided at a side thereof with an inner threaded and stepped recess which receives varieties of elements of the gas injection regulating unit 60. In order to mount the regulating unit on the mounting base 51, a cylindrical supporter 64 having a gas suction pipe 65 is inserted in the lowest section or a smallest diameter section of the recess. This supporter 64 has an enlarged diameter section at its top to be seated on the lower step of the recess. A cylinder 61 having a gas inlet 63 is in turn hermetically received in a middle diameter section of the recess on the cylindrical supporter 64. The hermetic reception of the cylinder 61 in the middle diameter section of the recess is achieved by an O-ring 62 received in an annular groove of the cylinder 61.

Thereafter, the gas injection regulating unit 60 is inserted in the largest diameter section, or the inner threaded section of the recess, on the cylinder 61. In order to insert the unit 60 in the recess, a longitudinal gas inlet member 58 having an annular ridge 57 at its middle section is received at its lower end in a central opening 61*a* of the cylinder 61 such that it vertically moves in a predetermined range in the central opening 61*a*. This inlet member 58 is also biased by a compression coil spring 66 which is mounted about the inlet member 58 while being seated on the annular ridge 57 of the inlet member 58. The vertical position of the inlet member 58 in the recess of the mounting base 51 is maintained by a gas amount regulator 53 which has an outer threaded surface 52 and screws together with the inner threaded section of the recess. Here, the compression coil spring 66 is disposed between the upper shoulder of the gas amount regulator 53 and the annular ridge 57 of the gas inlet member 58, so that the gas inlet member 58 is normally biased downwardly as shown in the drawing. The upper section of the gas amount regulator 53 has an outer serration 53*a* engaging with a gas amount regulating valve 54. The gas inlet member 58 is provided with a gas nozzle of the conical frustum 55 at its top and with an axial gas introducing hole 58*a* which communicates with the central opening of the gas amount regulator 53 through a radial hole 59 which is formed at the lower section of the member 58 below the annular ridge 57. A packing 68 is mounted on the bottom of the gas inlet member 58 to block the lower end of the gas introducing hole 58*a*. This packing 68 also normally achieves hermetic sealing of a smaller diameter section of the central opening 61*a* of the cylinder 61, so that the smaller diameter section of the central opening 61*a* does not communicate with the gas introducing hole 58*a* of the gas inlet member 58 when the inlet member 58 is fully biased downwardly by the compression coil spring 66 as shown in the drawing.

In order to prepare the gas lighter having the aforementioned gas injection regulating unit, the main body 50 and the mounting base 51 should be separately produced and hermetically bonded to each other, such as by employing a high frequency bonding, thereby causing difficulty in the preparation process of the gas lighter.

In operation of the known gas lighter, the liquified gas charged in the gas tank of the main body 50 is vaporized and introduced into the cylinder 61 through the gas suction pipe 65 and the gas inlet 63 of the cylinder 61 in order and, thereafter, remains in the central opening 61*a* of the cylinder 61. At this time, the packing 68 hermetically seals the opening 61*a* of the cylinder 61 such that the opening 61*a* does not communicate with the gas introducing hole 58*a* of the gas inlet member 58. No gas is thus introduced to the hole 58*a*. Upon pressing down a thumb operable lever (not shown) simultaneously with rotating a spool sparker (not shown) coming into frictional contact with a lighter flint (not shown), a biasing section 55*a* of the lever brought into engagement with the gas nozzle 55 is lifted to bias the gas inlet member 58 upwardly while compressing the compression coil spring 66. Thus, the packing 68 of the member 58 moves upwards to escape from the smaller diameter section of the central opening 61*a* and to be located about a larger diameter section of the opening 61*a*, thereby causing the gas to be introduced from the smaller diameter section of the central opening 61*a* of the cylinder 61 to the gas introducing hole 58*a* of the gas inlet member 58 through the radial hole 59 prior to gas projection from the gas nozzle 55. At the same time of the gas projection from the gas nozzle 55, sparks are generated as a result of friction between the rotating spool sparker and the lighter flint and ignites the gas projected from the gas nozzle 55 to form the flame. The size of the flame or the force of the fire is controlled by rotating the gas regulating valve 54 which varies the screwing position of the gas amount regulator 53 with respect to the mounting base 51. When the valve 54 is rotated, the size of the inner space of the cylinder 61 is varied to control the gas pressure inside the cylinder 61.

However, the above gas lighter has a problem in that its repeated use inevitably causes abrasion of the packing 68 due to the friction between the packing 68 and the inner surface of the cylinder 61, thereby causing the presence of leakage of gas from the inside to the outside of the cylinder 61. Moreover, the above gas lighter comprises variety of elements and has a complex construction, thereby causing a problem of increasing of the preparation cost as well as of complication of the assembling process requiring longer assembling time. In addition to the above problems, the known gas lighter is attended with inconvenience in carrying the same.

SUMMARY OF THE INVENTION

It is, therefore an object of the present invention to provide a cigarette-shaped gas lighter in which the aforementioned problems can be overcome and which reduces the number of elements to simplify the preparation process and to cause a drop of preparation cost and maintains a desired force of the fire by causing a predetermined amount of gas to be projected from the gas nozzle with no additional control, and which is suitable for carrying in a conventional cigarette pack as if it was a cigarette.

To accomplish the above object, a cigarette-shaped gas lighter in accordance with the present invention comprises: a solid main body having a mounting base at its upper section, the mounting base having a recess for receiving a gas injection regulating unit, the recess being stepped twice such that it has upper and lower shoulders; a spark generating unit mounted on the mounting base, the spark generating unit comprising: a lighter flint upwardly biased by a spring received in the mounting base; and a sparker supported by a pair of support columns extending upwardly from the mounting base, the sparker being serrated at its sparking surface and coming into frictional contact with the top of the lighter flint to generate a spark; the gas injection regulating unit being received in the recess of the mounting section of the main body, the gas injection regulating unit comprising: a cylinder received in a larger section of the recess such that a top end of the cylinder comes into close contact with the lower shoulder of the recess; and a gas regulating member having a gas inlet chamber at its lower section and having a gas nozzle at its upper end, the member being received in the recess such that the gas inlet chamber is closely received in the cylinder and the gas nozzle protrudes out of the mounting section of the main body, the member being biased downwardly by a spring supported between the upper shoulder of the recess and the gas inlet chamber with a packing interposed between the upper shoulder and the top of the spring; a lever pin for lifting the gas injection regulating unit to allow gas to be projected from the gas nozzle of the gas regulating member, the lever pin including a clip extending downwardly from its press surface for clipping the gas lighter; a cap having a gas recharger, the cap hermetically screwing on the bottom of the main body with a packing interposed therebetween; and a top cover mounted on the mounting section of the main body, the top cover having a flame projection opening for allowing a flame projected from the gas nozzle to rush to the outside of the gas lighter.

BRIEF DESCRIPTION OF THE DRAWINGS

The above and other objects, features and other advantages of the present invention will be more clearly understood from the following detailed description taken in conjunction with the accompanying drawings, in which:

FIGS. 5A and 5B are enlarged sectional views of a gas injection regulating unit of the gas lighter in accordance with a primary embodiment of the present invention, respectively, in which:

FIG. 5A shows a closed state of the unit for restricting the gas projection from a gas nozzle; and FIG. 5B shows an opened state of the unit for allowing the gas projection;

DESCRIPTION OF THE PREFERRED EMBODIMENTS

Figure 1:
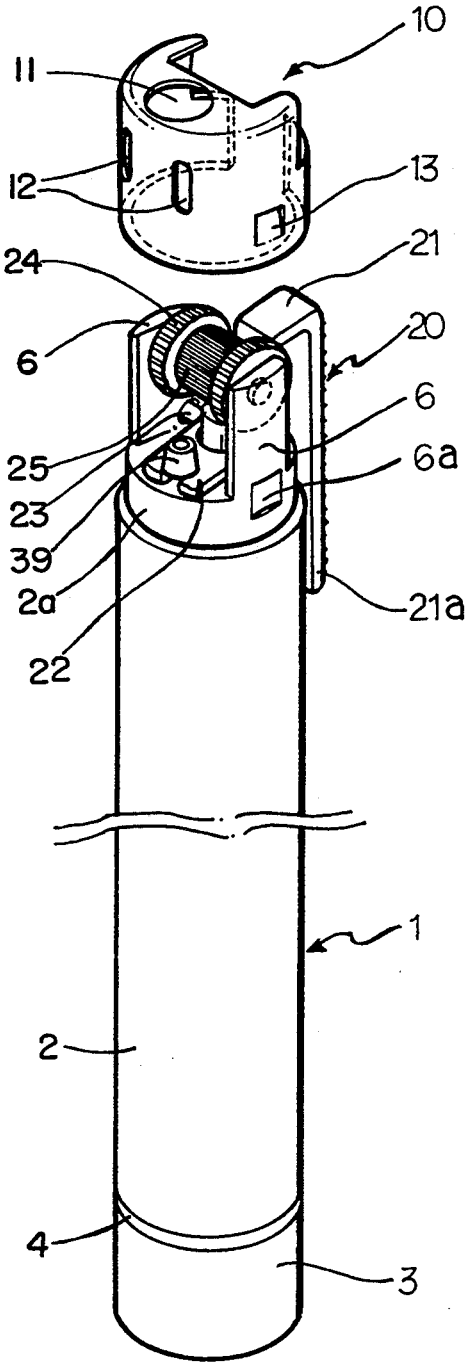
FIG. 1 is a perspective view of a cigarette-shaped gas lighter in accordance with the present invention with a top cover separated from a main body.
Figure 2:
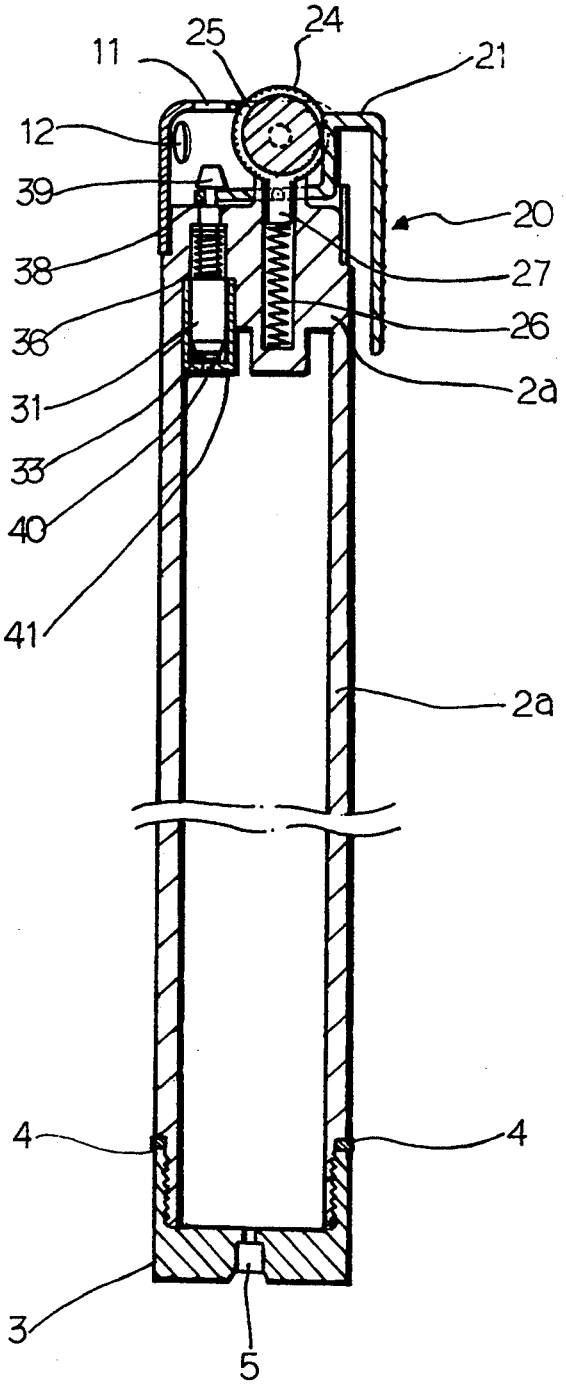
FIG. 2 is a vertical sectional view of a cigarette-shaped gas lighter in accordance with a primary embodiment of the present invention.

With reference to FIGS. 1 and 2, a cigarette-shaped gas lighter in accordance with an embodiment of the present invention is shown in a perspective view and in a vertical sectional view, respectively.

Figure 5A:
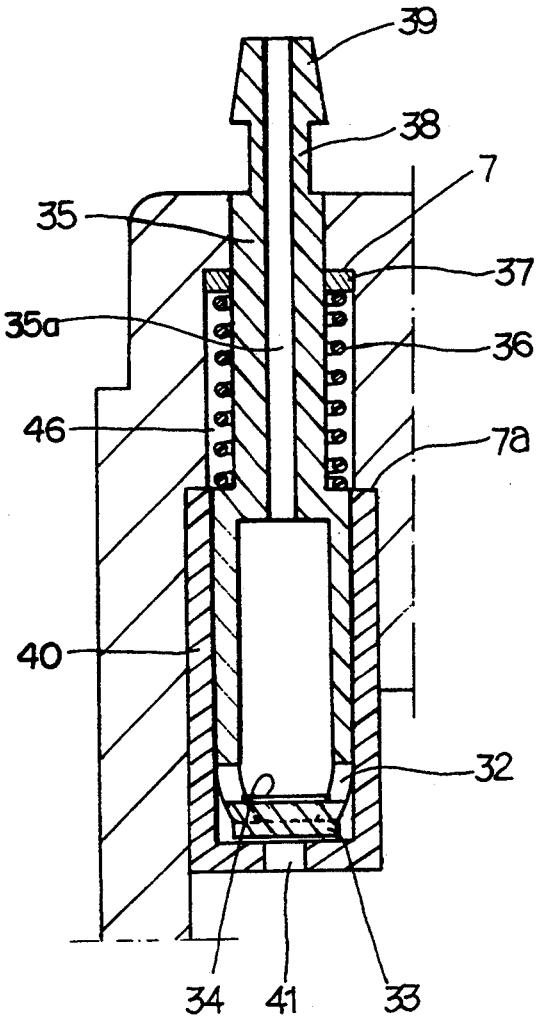

The gas lighter of this invention has a slender cylindrical shape and includes a spark generating unit. The spark generating unit comprises a lighter flint 27, upwardly biased by a compression coil spring 26 received in a cylindrical recess, and a rotatable serrated sparker 24 of the spool type of which the serrated middle surface 25 comes into frictional contact with the top of the spring-biased lighter flint 27. The spool sparker 26 is rotatably supported at its both sides by a pair of support columns 6. A gas nozzle 39 of a gas injection regulating member 30 is disposed at the front of the spark generating unit such that it is optionally lifted by a thumb operable lever pin 20. This gas nozzle 39 is brought into slidable engagement with a slitted biasing section 22 of the thumb operable lever pin 20 such that it is biased upwardly by the biasing section 22 when a press surface 21 of the lever pin 20 is pressed down. Thus, the gas is projected from the gas nozzle 39 and ignited by the sparks generated by the spark generating unit to form a flame which rushes to the outside of the lighter through a flame projection opening 11 of a top cover 10, The gas lighter of this invention comprises a solid main body 2 which has a mounting upper section **2*a* for mounting an ignition device, including the gas injection regulating member 30, on the main body 2. The bottom of the main body 2 is opened and has an outer threaded surface. An inner threaded cap 3 provided with a gas recharger 5 at its center screws on the bottom of the main body 2 with an annular packing 4 interposed between a shoulder of the inner threaded surface of the main body 2 and the annular top of the cap 3, thereby achieving a hermetic sealing between the main body 2 and the cap 3. The length and the diameter of the gas lighter are same as those of a cigarette such that it is received in a cigarette pack as if it was a cigarette. As best seen in FIG. 5A, the mounting upper section 2***a* of the main body 2 is provided with a vertical space 46 for receiving the gas injection regulating member 30 therein. This space 46 is stepped twice such that it has upper and lower shoulders 7 and 7*a*. In the larger diameter section of the two stepped space 46, a cylinder 40, of which the top is opened and the bottom is provided with a gas inlet 41, is tightly inserted. The top of the cylinder 40 comes into close contact with the lower shoulder 7*a* of the two stepped space 46. The gas injection regulating member 30 having the gas nozzle 39 at its top is tightly received in the cylinder 40 such that its larger diameter section or a gas inlet chamber 31 is tightly received in the cylinder 40 and its gas nozzle 39 vertically protrudes out of the mounting section 2*a* of the main body 2. The gas inlet chamber 31 of the member 30 is larger in diameter than the other parts of the member 30, so that the member 30 includes a stepped portion at its middle section. In order to allow the gas to be projected from the gas nozzle 39 as occasion demands, the gas regulating member 30 is lifted by the lever pin 20 in a conventional manner. A compression coil spring 36 is mounted about the gas regulating member 30 between the stepped portion of the member 30 and the upper shoulder 7 of the two stepped space 46 to return the gas regulating member 30 to its lowered position when the outer force acting on the press surface 21 of the lever pin 20 is removed therefrom, A packing 37 is interposed between the top of the spring 36 and the upper shoulder 7 of the space 46 to achieve the hermetic isolation of the two stepped space 46 from the outside.

The lever pin 20 includes a clip section 21*a* which downwardly extends from the press surface 21. The clip section 21*a* positions the cigarette-shaped gas lighter in a place, such as at a state of clipping on a cigarette pack or on a pocket, thereby preventing the gas lighter from loss.

Figure 4:
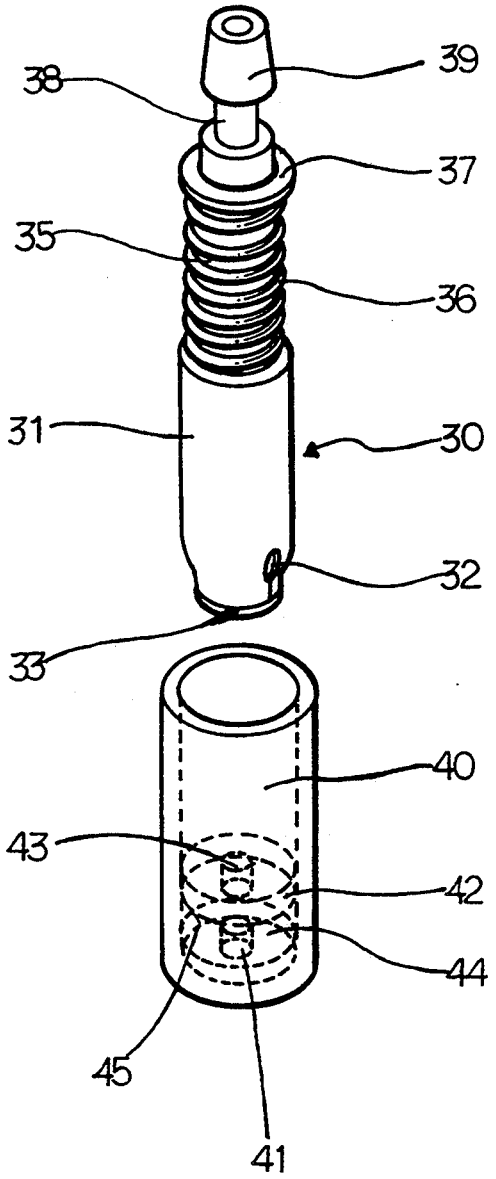
FIG. 4 is an exploded perspective view of a gas injection regulating unit of the gas lighter in accordance with the present invention.
Figure 5B:
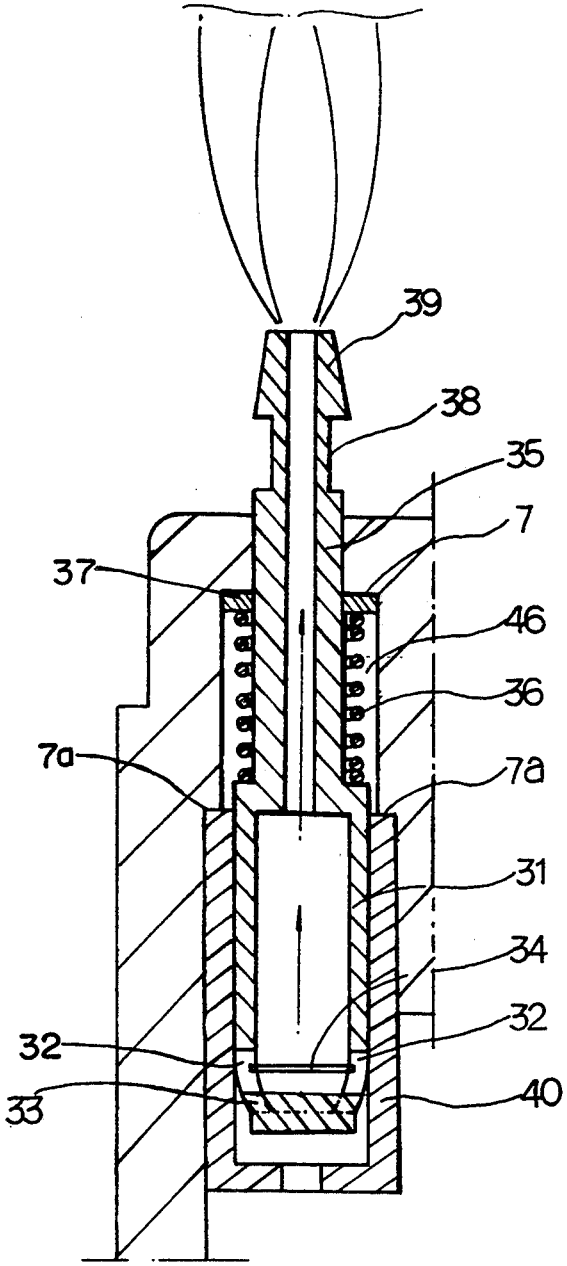

As shown in FIGS. 4, 5A and 5B, the gas injection regulating unit comprises the gas injection regulating member 30 and the cylinder 40 receiving the lower section of the member 30. The top of the gas regulating solid member 30 defines the gas nozzle 39 of the conical frustum from which a middle outer diameter section 35 integrally extends downwardly through a smaller outer diameter section 38 which is brought into engagement with the slitted biasing section 22 of the thumb operable lever pin 20. The gas inlet chamber 31 having the larger outer diameter integrally extends downwardly from the middle outer diameter section 35 of the member 30. This gas inlet chamber 31 is provided with radial gas inlet holes 32 at its lower section which is gradually reduced in its diameter. The gas regulating member 30 further includes a gas regulating plate 34, which is laterally disposed in the lower section of the gas inlet chamber 31, and a packing 33 fixed to the lower end of the gas inlet chamber 31. The gas inlet chamber 31 of the member 30 is tightly received in the cylinder 40 of which the top is opened and the bottom is provided with the axial gas inlet 41.

Figure 6A:
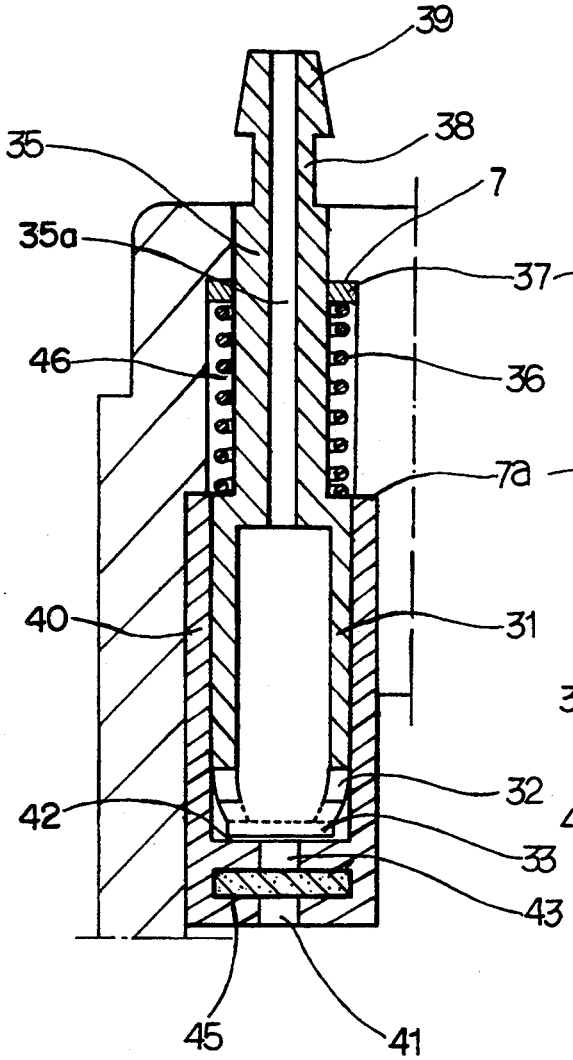
FIG. 6A is a sectional view of a cigarette-shaped gas lighter in accordance with a second alternate embodiment of the present invention.
Figure 6B:
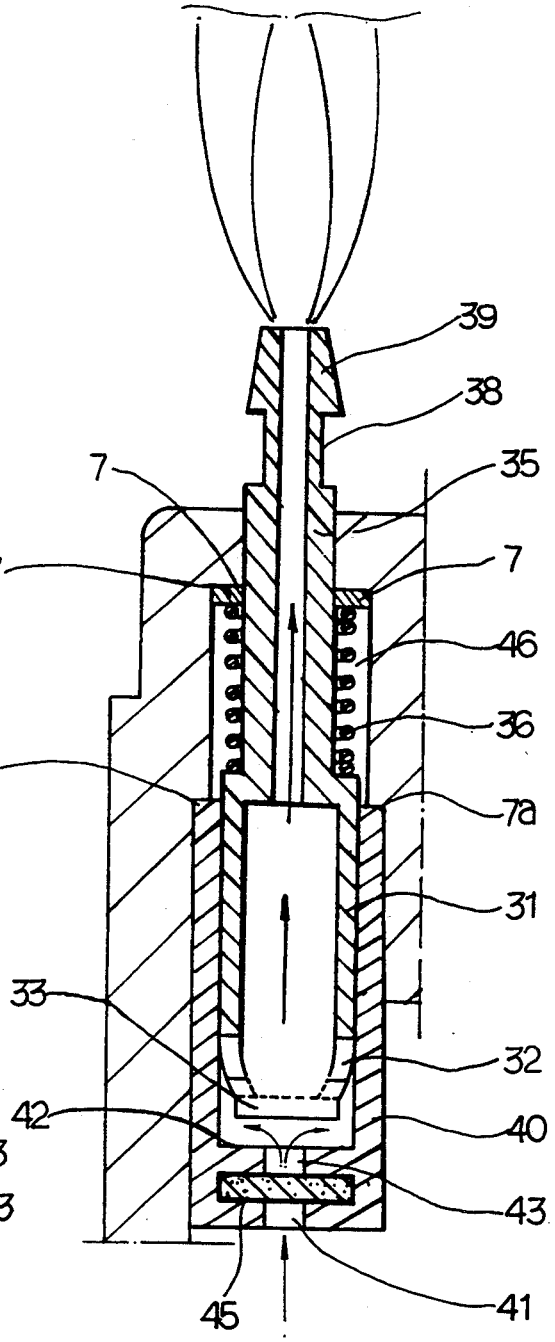
FIG. 6B is a sectional view of the gas lighter of FIG. 6A for showing a lighting operation of the lighter.
Figure 7:
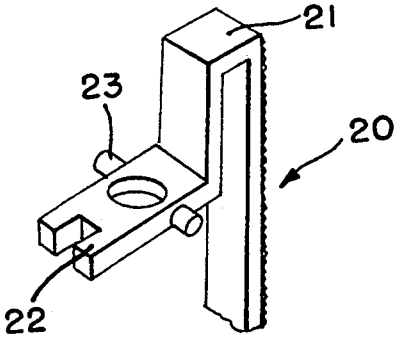
FIG. 7 is a perspective view of a thumb operable lever pin of the gas lighter of the present invention.
Figure 8:
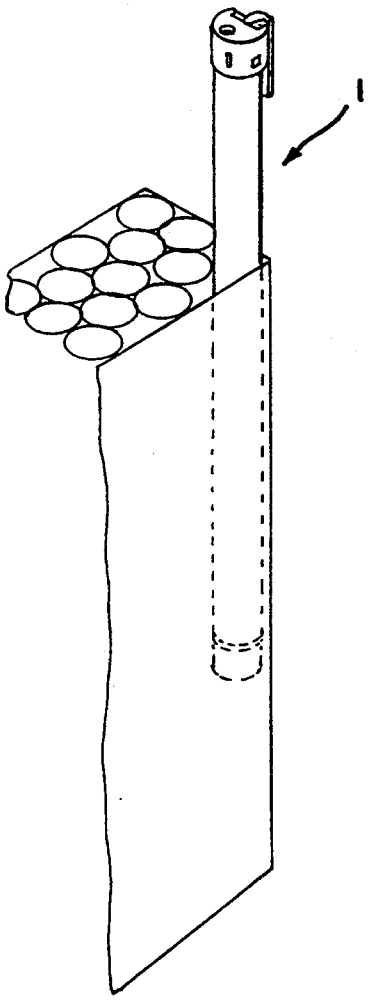
FIG. 8 is a perspective view showing the cigarette-shaped gas lighter of the present invention received in a conventional cigarette pack.
Figure 9:
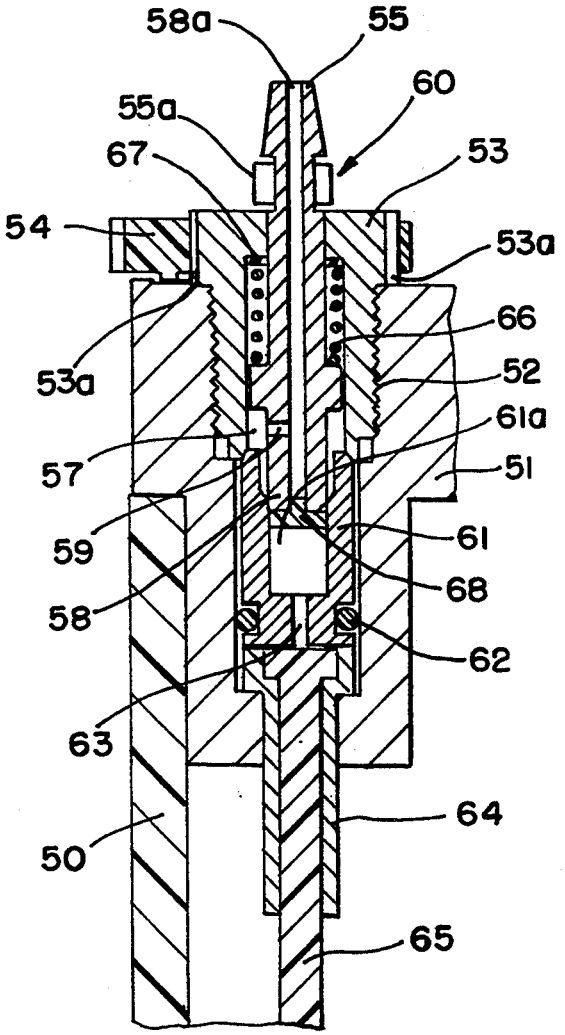
FIG. 9 (PRIOR ART)
FIG. 9 is a partial sectional view of a gas lighter accordance with the prior art.

Turning to FIGS. 6A and 6B, there is shown a gas injection regulating unit of a cigarette-shaped gas lighter in accordance with a second alternate embodiment of the present invention. In the second alternate embodiment, the general shape of the gas injection regulating unit remains the same as in the primary embodiment of FIGS. 5A and 5B, but the bottom of the cylinder is altered to include a filter 45. That is, the gas inlet chamber 31 is provided with the radial gas inlet holes 32 at its lower section which is gradually reduced in its diameter. The packing 33 is fixed to the lower end of the gas inlet chamber 31 in the same manner as described for the primary embodiment. However, the cylinder 40 is also provided with a radial plate 42 which integrally radially extends from the inner surface of the cylinder 40 to provide an axial outlet 43 and to be spaced apart from the bottom plate having the gas inlet 41 at a predetermined interval. The filter 45 is tightly received in a lateral space 44 defined between the radial plate 42 and the bottom plate of the cylinder 40.

Figure 3:
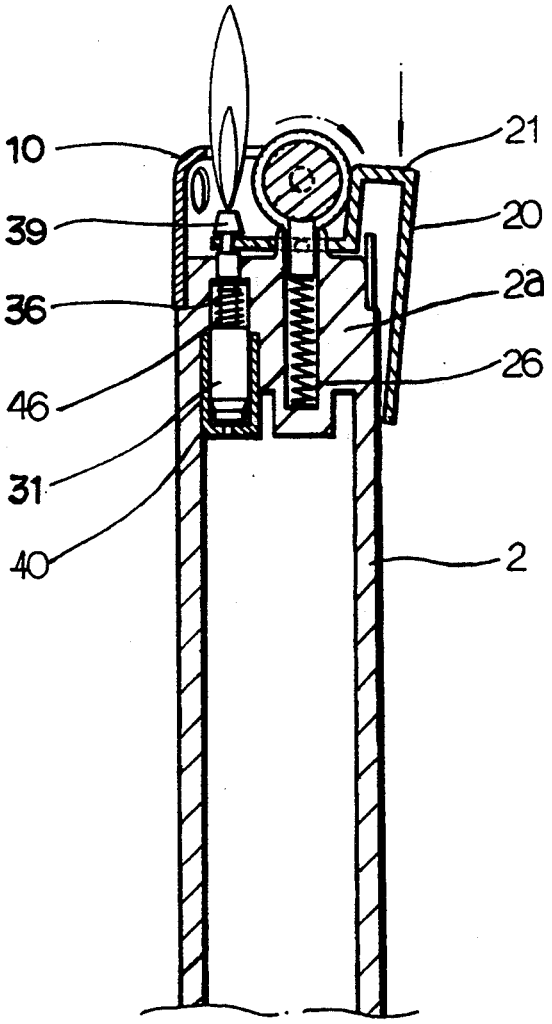
FIG. 3 is an enlarged sectional view of the upper section of the lighter of the present invention for showing a lighting operation of the lighter.

In operation of the gas lighter having the gas injection regulating unit according to the primary embodiment of the present invention, the serrated spool sparker 24 rotatably supported by the pair of support columns 6 is rotated clockwise by a thumb as shown at the curved arrow of FIG. 3. Because of the neighboring arrangement of the spool sparker 24 and the press surface 21 of the lever pin 20, the thumb after rotation of the spool sparker 24 naturally presses down the press surface 21. Here, the serrated spool sparker 24 comes into frictional contact with the spring-biased lighter flint 27, so that the rotation of the serrated spool sparker 24 results in generation of sparks. Upon pressing down the press surface 21 of the thumb operable lever pin 20, the slitted biasing section 22 brought into engagement with the gas nozzle 39 rises centering about a point of action of a shaft 23 (see FIG. 1) to lift the gas regulating member 30 while compressing the compression coil spring 36 as shown in FIG. 5B.

Thus, the packing 33 of the member 35, having blocked the gas inlet 41 of the cylinder 40, moves upwards to be separated from the gas inlet 41. Such a separation of the packing 33 from the gas inlet 41 allows the gas to be introduced from the inside of the main body 1 to the inside of the cylinder 40 through the gas inlet 41. The gas is in turn introduced into the inside of the gas inlet chamber 31 of the member 30 through the radial gas inlet holes 32 and, thereafter, projected from the gas nozzle 39. Simultaneously with projecting from the gas nozzle 39, the gas is ignited by the sparks generated by the spool sparker 24 to form a flame which in turn rushes to the outside of the lighter through the flame projection opening 11 of the top cover 10. At this time, the outside air is continuously supplied to the flame through air inlets 12 formed on the top cover 10, thereby continuing the flame generation without extinguishment.

When it is achieved to light a cigarette using the flame, the downward pressure acting on the press surface 21 of the lever pin 20 is removed therefrom, such as by removing the thumb from the press surface 21. The restoring force of the compression coil spring 36 causes the gas regulating member 30 to return to its lowered position while turning the lever pin 20 counterclockwise about the shaft 23 as shown in FIG. 2. When the gas regulating member 30 returns to its lowered position as best seen in FIG. 5A, the packing 33 blocks the gas inlet 41 of the cylinder 40, so that the gas supply is shut off to extinguish the flame.

Particularly, FIGS. 5A and 5B show in detail the operation of the gas injection regulating unit of the cigarette-shaped gas lighter of the present invention. The gas injection regulating unit is received in the stepped space of the mounting upper section 2*a* integrally formed with the main body 2.

As shown in FIG. 5A, at the lower position of the gas inlet member 35, the packing 33 fixed to the lower end of the gas inlet chamber 31 of the member 30 is simply seated on the bottom of the cylinder 40 to block the gas inlet 41 of the cylinder 40, so that there is no presence of abrasion of the packing 33 irrespective of repeated use of the gas lighter. The packing 33 thus retains its shape and continues its sealing function until the lighter ends its useful life, thereby improving the reliability of the lighter.

The gas regulating plate 34, disposed directly above the packing 33 inside the gas inlet chamber 31, is made of a light and thin material and has a characteristic in that its floating height in the gas inlet chamber 31 is varied in accordance with outside temperature. Otherwise stated, at a higher temperature such as in summer, the gas regulating plate 34 floats at a predetermined level above the packing 33 due to a higher expansion pressure of the inlet gas to heighten its height in the gas inlet chamber 31 as shown in FIG. 5B. In this case, the gas regulating plate 34 does not allow all of the inlet gas to be projected from the gas nozzle 39 but allow only the gas inlet through the section of the gas inlet holes 32 above the plate 34, thus reducing the size of the flame. On the contrary, at a lower temperature such as in winter, the gas regulating plate 34 lowers since the inlet gas does not actively expands but is compressed, thus nearly coming into contact with the packing 33. In this case, the gas regulating plate 34 allows most part of the inlet gas to be projected from the gas nozzle 39, thus increasing the size of the flame.

Upon rotating the serrated spool sparker 24 and pressing down the press surface 21 of the lever pin 20 in order to light a cigarette using the gas lighter, the gas injection regulating member 30 is lifted in the cylinder 40 while compressing the compression coil spring 36 as shown in FIG. 5B. The lift of the gas regulating member 30 is attended with lift of the gas inlet chamber 31 as well as separation of the packing 33 from the gas inlet 41 of the cylinder 40, thus opening the gas inlet 41. The gas is thus introduced from the inside of the main body 2 to the inside of the cylinder 40 and in turn introduced to the inside of the gas inlet chamber 31 of the member 30 through the radial gas inlet holes 32. At this time, an amount of the inlet gas of the gas inlet chamber 31 is controlled by the gas regulating plate 34 of which the floating height is varied in accordance with the temperature. The gas is in turn raised through an axial gas passage 35*a* of the gas injection regulating member 30 to be projected from the gas nozzle 39. Simultaneously with projection of the gas from the gas nozzle 39, the gas is ignited by the sparks generated by friction between the serrated middle surface 25 of the rotating spool sparker 24 and the lighter flint 27 to form the flame.

When the downward pressure acting on the press surface 21 of the lever pin 20 is removed therefrom, the gas injection regulating member 30 returns to its lowered position due to the restoring force of the compression coil spring 36. At this time, the packing 33 of the member 30 blocks the gas inlet 41 of the cylinder 40, so that the gas supply is shut off to extinguish the flame.

In operation of the gas lighter according to the second alternate embodiment of FIGS. 6A and 6B, the gas is introduced from the inside of the main body 2 to the lateral space 44, provided between the radial plate 42 and the bottom plate of the cylinder 40, through the gas inlet 41. At this time, the packing 33 of the gas injection regulating member 30 blocks the gas outlet 43 of the radial plate 42, so that the gas is not introduced into the inside of the cylinder 40 but remains in the filter 45 received in the lateral space 44. Upon rotating the serrated spool sparker 24 and pressing down the press surface 21 of the lever pin 20 in order to light a cigarette using the gas lighter, the gas injection regulating member 30 is lifted in the cylinder 40 while compressing the compression coil spring 36 as shown in FIG. 6B. The lift of the gas injection regulating member 30 is attended with lift of the gas inlet chamber 31 as well as separation of the packing 33 from the gas outlet 43 of the radial plate 42 to open the gas outlet 43. The gas is thus introduced to the inside of the cylinder 40 and in turn introduced to the inside of the gas inlet chamber 31 of the member 30 through the radial gas inlet holes 32. Thereafter, the gas is raised through the axial gas passage 35*a* of the gas injection regulating member 30 to be projected from the gas nozzle 39. Simultaneously with projection of the gas from the gas nozzle 39, the gas is ignited by the sparks generated by the friction between the rotating spool sparker 24 and the lighter flint 27 to form the flame. The filter 45 of the second alternate embodiment results in the same effect as that of the gas regulating plate 34 provided in the gas inlet chamber 31 of the primary embodiment and further explanation is thus not deemed necessary.

As described above, the cigarette-shaped gas lighter of the present invention simplifies its construction and reduces the number of its elements, thus simplifying the preparation process and reducing the preparation cost. An amount of the gas projected from a gas nozzle is controlled by a gas regulating plate, laterally disposed in a gas inlet chamber of a gas injection regulating member such that its floating height is varied in accordance with outside temperature, or by a filter provided in a cylinder, so that the flame maintains a desired size. Furthermore, the gas lighter of the present invention has the same shape and the same size as those of a conventional cigarette, so that it is carried with one while being received in a cigarette pack as if it was a cigarette.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A cigarette-shaped gas lighter comprising:

a solid main body;

a mounting base formed at an upper section of said solid main body;

a twice-stepped recess formed in said mounting base, said recess having upper and lower shoulders;

a gas injection regulating unit formed in said recess;

a spark generating unit mounted on said mounting base, said spark generating unit including a lighter flint upwardly biased by a spring received in said mounting base, and a sparker supported by a pair of support columns extending upwardly from said mounting base, said sparker being serrated at its sparking surface and coming into frictional contact with the top of said lighter flint to generate a spark;

said gas injection regulating unit including a cylinder received in a larger section of said recess such that a top end of said cylinder comes into close contact with the lower shoulder of said recess, and a gas regulating member having a gas inlet chamber at its lower section and a gas nozzle at its upper end, the gas regulating member being received in said recess such that said gas inlet chamber is closely received in said cylinder and said gas nozzle protrudes out of said mounting section of said main body, said gas regulating member being biased downwardly by a spring supported between the upper shoulder of said recess and said gas inlet chamber with a packing interposed between said upper shoulder and the top of said spring;

a lever pin for lifting said gas injection regulating unit to allow gas to be projected from said gas nozzle of said gas regulating member, said lever pin including a clip extending downwardly from its press surface for clipping said gas lighter;

a cap having a gas recharger, said cap being hermetically screwed on the bottom of said main body with a packing interposed therebetween; and a top cover mounted on said mounting section of said main body, said top cover having a flame projection opening for allowing a flame projected from said gas nozzle to rush to the outside of said gas lighter, whereby said gas lighter, having the same length and the same diameter as those of a conventional cigarette, is carriable in a conventional cigarette pack.

2. The cigarette-shaped gas lighter according to claim 1, wherein said cylinder is opened at its upper section and has a gas inlet at its bottom plate, and said gas regulating member has a solid body comprising:

a conical frustum shaped gas nozzle;

a smaller diameter section integrally extending downwardly from said gas nozzle, said smaller diameter section engaging with said lever pin;

a middle diameter section integrally extending downwardly from said smaller diameter section;

said gas inlet chamber integrally extending downwardly from said middle diameter section, said gas inlet chamber being provided with a radial gas inlet holes at its lower section gradually reduced in diameter, the inside of said gas inlet chamber communicating with said gas nozzle as well as with the inside of said cylinder;

a gas regulating plate laterally arranged in a lower section of said gas inlet chamber; and a packing fixed to a lower end of said gas inlet chamber for selectively blocking said gas inlet of said cylinder.

3. The cigarette-shaped gas lighter according to claim 1, wherein said gas inlet chamber of said gas regulating member is provided with a radial gas inlet hole at its lower section gradually reduced in the diameter, and fixed to a packing at its lower end, and said cylinder is provided with a radial plate integrally radially extending from an inner surface of said cylinder to provide an axial gas outlet, said radial plate being spaced apart from a bottom plate of said cylinder having a gas inlet at a predetermined interval to provide a lateral space therebetween for receiving a filter.

* * * * *